US008202142B2

(12) United States Patent
Tsujisawa et al.

(10) Patent No.: US 8,202,142 B2
(45) Date of Patent: Jun. 19, 2012

(54) APPARATUS FOR CUTTING LATERAL WALL OF PIPE

(75) Inventors: Takahiko Tsujisawa, Ashikaga (JP); Takao Kamiyama, Hiratsuka (JP)

(73) Assignee: Shonan Gosei-Jushi Seisakusho K.K. (JP)

( * ) Notice: Subject to any disclaimer, the term of this patent is extended or adjusted under 35 U.S.C. 154(b) by 540 days.

(21) Appl. No.: 12/381,046

(22) Filed: Mar. 6, 2009

(65) Prior Publication Data

US 2009/0223336 A1 Sep. 10, 2009

(30) Foreign Application Priority Data

Mar. 7, 2008 (JP) ..... 2008-057888

(51) Int. Cl.
*B24C 3/08* (2006.01)

(52) U.S. Cl. ..... 451/76; 451/92

(58) Field of Classification Search ..... 451/76, 451/92

See application file for complete search history.

(56) References Cited

U.S. PATENT DOCUMENTS

| | | | | | |
|---|---|---|---|---|---|
| 4,577,388 | A * | 3/1986 | Wood | 29/558 |
| 4,982,490 | A * | 1/1991 | Franklin | 29/890.14 |
| 5,197,540 | A * | 3/1993 | Yagi et al. | 166/55.8 |
| 5,368,423 | A * | 11/1994 | Hanna | 409/132 |
| 5,515,886 | A * | 5/1996 | Granella | 138/98 |
| 5,540,613 | A * | 7/1996 | Kamiyama et al. | 451/24 |
| 5,899,796 | A * | 5/1999 | Kamiyama et al. | 451/61 |
| 5,960,882 | A * | 10/1999 | Polivka | 166/297 |
| 6,056,017 | A * | 5/2000 | Kamiyama et al. | 138/98 |
| 6,386,797 | B1 * | 5/2002 | Gearhart | 405/184.3 |
| 6,508,975 | B1 * | 1/2003 | Godlewski et al. | 266/55 |

* cited by examiner

*Primary Examiner* — Maurina Rachuba
(74) *Attorney, Agent, or Firm* — Adams & Wilks

(57) ABSTRACT

A cutting apparatus cuts a lateral wall of a manhole to form a hole on the lateral wall of the manhole. A circular pipe is harmonized with a main pipe and fixedly disposed therein. A rotary ring configured so as to be able to rotate along the periphery of an opening in the manhole about the axial center of the main pipe is mounted on the circular pipe. A pressurized fluid material or pressurized granular material is sprayed from a nozzle held in the rotary ring. The rotary ring is rotated and the lateral wall of the manhole is cut through along the periphery of the opening in the manhole by the fluid material or granular material sprayed from the nozzle. Since the cut portion is shaped as a circle symmetrical about the axial center of the main pipe, it is possible to form a circularly shaped cut-through part centered along the periphery of the opening in the manhole without accidentally breaking or damaging the lateral wall thereof.

9 Claims, 7 Drawing Sheets

APPARATUS FOR CUTTING LATERAL WALL OF PIPE

BACKGROUND OF THE INVENTION

1. Field of the Invention

The present invention relates to an apparatus for cutting a lateral wall of a pipe, and more particularly to an apparatus for cutting a lateral wall of a manhole (first pipe) to form a hole in the lateral wall of the manhole that is provided with an opening at which the manhole intersects and communicates with a sewer pipe or other main pipe (second pipe).

2. Description of the Related Art

In the prior art, a hole is formed in a lateral wall of a manhole around a sewer pipe connected to the manhole, and hard rubber or another elastic member is inserted into the resulting hole to make the main pipe quakeproof. To form the hole in the lateral wall of the manhole, for example, a cutter such as a drill is circularly rotated along the periphery of an opening in the manhole that communicates with the main pipe (JP-A-2002-227226).

A centering device may also be used to harmonize the axial center with the axial center of the main pipe, and a chainsaw or other cutter is used to cut the wall surface of the manhole (JP-A-2006-57390).

However, a problem of the method for drilling a hole in a lateral wall of a manhole in accordance with JP-A-2002-227226 is that it is difficult to position the rotational center of a drill, and a problem of the solution offered in JP-A-2006-57390 is that the components must be centered using a centering device.

Another drawback of both methods is that because a hole is drilled or cut with a metal drill or chainsaw, the lateral wall of the manhole may be broken or damaged in an unintended area, compromising the quakeproof properties of the manhole.

SUMMARY OF THE INVENTION

An object of the present invention is to provide an apparatus for cutting a lateral wall of a pipe so that a lateral wall of a pipe can be cut without accidentally breaking or damaging the lateral wall thereof, and a circularly shaped through-cut part centered on the lateral wall of the pipe can be formed.

According to the present invention, there is provided an apparatus for cutting a lateral wall of a first pipe to form a hole in the lateral wall thereof. The first pipe has an opening at which the first pipe intersects and communicates with a second pipe. The apparatus comprises a fixed member which is fixedly disposed in the second pipe, the fixed member being harmonized with the diameter of the second pipe; a rotating member linked to the fixed member so as to be able to rotate inside the first pipe along a periphery of the opening thereof about an axial center of the second pipe; and a nozzle having a spray port that is held in the rotating member such that the spray port faces an internal surface of the lateral wall of the first pipe. The rotating member is rotated relative to the fixed member, and a pressurized fluid material or a pressurized granular material is sprayed from the spray port of the nozzle to cut the lateral wall along the periphery of the opening in the first pipe.

In the present invention, the lateral wall of the first pipe is cut by the pressurized fluid material or pressurized granular material sprayed from the nozzle, making it possible to make a precise cut in the intended portion without breaking or damaging the periphery of the cut portion, unlike in a case in which a metal cutter or the like is used for cutting.

Also in the present invention, the rotating member in which the nozzle is held is mounted in a fixed member so as to be able to rotate about the axial center of the second pipe. This allows a circular through-cut part centered on the periphery of the opening in the first pipe to be formed in a simple manner.

Further features of the invention, its nature and various advantages will be more apparent from the accompanying drawings and following detailed description of the invention.

DESCRIPTION OF THE PREFERRED EMBODIMENTS

The present invention will now be described in detail with reference to the embodiments shown in the attached drawings. The embodiments are described with reference to a case in which a manhole is the first pipe, and a sewer pipe or other main pipe buried underground is the second pipe. However, the present invention is not limited to these embodiments alone and can be applied to an apparatus for cutting a lateral wall of the first pipe having an opening at which the first pipe intersects with the second pipe and communicates therewith.

Figure 1:
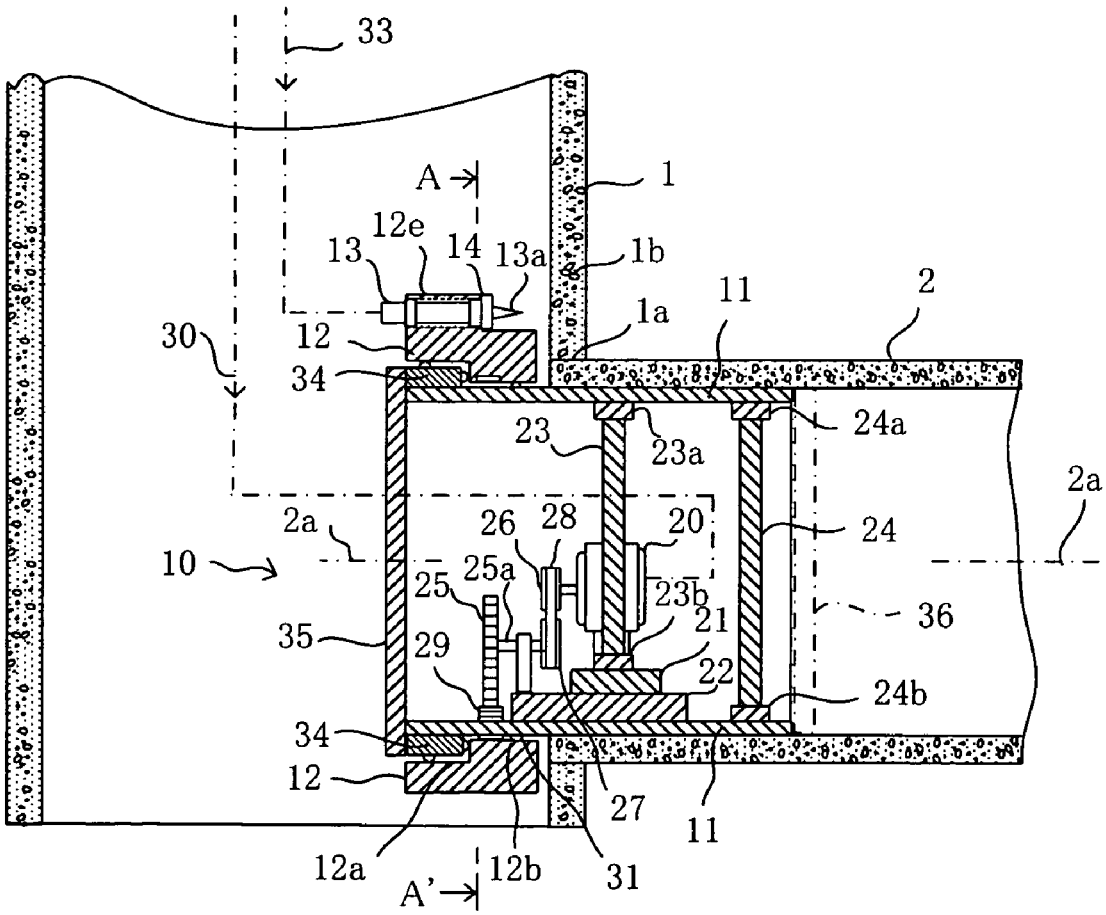
FIG. 1 is a vertical longitudinal sectional view showing an embodiment of a cutting apparatus according to the present invention.

A cutting apparatus 10 will now be described with reference to FIGS. 1 to 3. In FIG. 1, a main pipe 2 such as a sewer pipe is buried substantially horizontally underground so as to intersect at a substantially right angle with a manhole 1. A circular opening 1*a* that corresponds to the outside diameter of the main pipe 2 is formed in the lateral wall 1*b* of the manhole 1, and the main pipe 2 is inserted into the opening 1*a* so that the manhole 1 and main pipe 2 can communicate with each other via the opening 1*a*.

The cutting apparatus 10 includes a circular pipe 11 whose outside diameter is harmonized with the inside diameter (600 mm, 800 mm, etc.) of the main pipe 2, and a rotary ring 12 for holding a nozzle 13 is rotatably linked to the circular pipe 11 so as to be able to rotate relative to the circular pipe 11. The circular pipe 11 functions as a fixed member of the cutting apparatus 10, the rotary ring 12 functions as a rotating member, and the circular pipe 11 and rotary ring 12 can be separated from each other and are configured so as to be able to be assembled together.

A base 22 is fixed inside the circular pipe 11, and a drive motor 20 energized from a power source (not shown) via a line 30 is mounted on the base 22 via a mounting plate 21.

In the interior of the circular pipe 11, a columnar support 23 is provided in threaded engagement with support plates 23*a*, 23*b*, and a columnar support 24 in threaded engagement with support plates 24*a*, 24*b*. The support plate 23*a* of the columnar support 23 is disposed in the upper part of the circular pipe 11, the support plate 23*b* is disposed on the mounting plate 21, the support plate 24*a* of the columnar support 24 is disposed in the upper part of the circular pipe 11, and the support plate 24*b* is disposed in the lower part of the circular pipe 11. The support plates 23*a*, 23*b*, 24*a*, 24*b* are fixed, and the columnar supports 23, 24 are allowed to rotate so that the length (height) of the columnar supports 23, 24 in the circular pipe 11 can be adjusted. The adjustment allows the circular pipe 11 to be stretched so as to be in close contact with the main pipe 2 and press against the internal peripheral surface of the main pipe 2. This allows the axial center of the circular pipe 11 to be aligned substantially with the axial center 2*a* of the main pipe 2. The stretching of the circular pipe 11 by the columnar supports 23, 24 also makes it possible to prevent the circular pipe 11 from being slid by the spraying reaction of the nozzle 13.

A gear 25 that rotates on a shaft 25*a* is mounted on the base 22 of the circular pipe 11. The torque of the drive motor 20 is transmitted to the gear 25 via a power transmission mechanism comprising pulleys 26, 27 and a belt 28.

Figure 2:
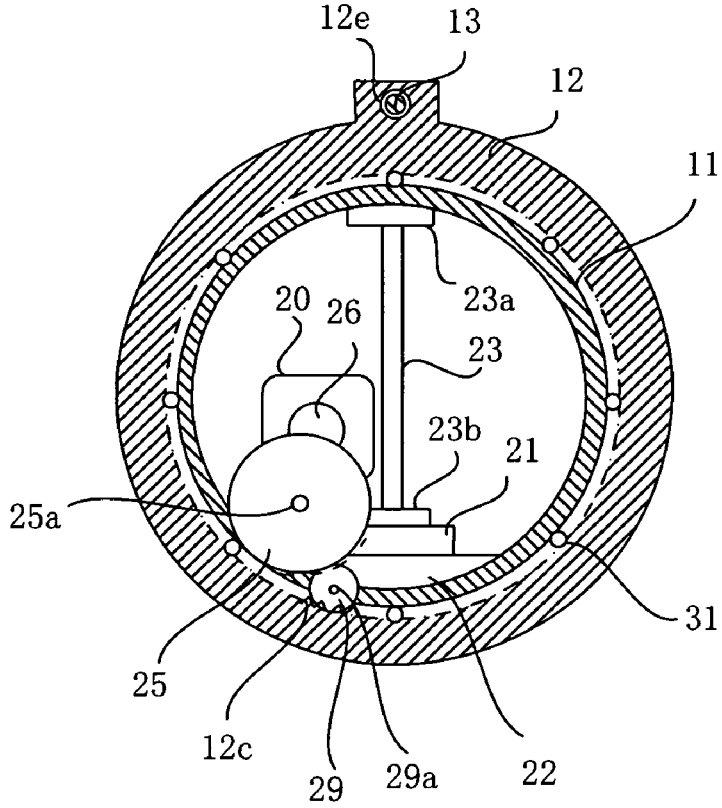
FIG. 2 is a cross-sectional view along line A-A in FIG. 1.
Figure 3:
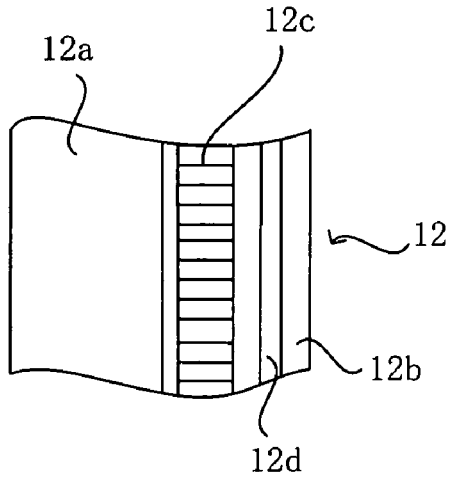
FIG. 3 is a top view of an internal surface of a rotary ring.

The rotary ring 12 is a stepped torus having an internal peripheral surface 12*a* and an internal peripheral surface 12*b* whose inside diameter is less than that of the internal peripheral surface 12*a*, and the rotary ring 12 is provided with internal teeth 12*c* along the entire circumference of the internal peripheral surface 12*b*, as shown in FIGS. 2 and 3. The internal teeth 12*c* are in meshing engagement with a gear 29 capable of rotating about an axle 29*a* (the bearings are not shown so as not to complicate the figures), and the gear 29 is in meshing engagement with a gear 25 and is rotated by the drive motor 20.

A ball bearing is provided to the external peripheral part of the circular pipe 11 in which the rotary ring 12 is mounted, and a guide groove 12*d* for guiding the balls 31 of the ball bearing is formed in the internal peripheral surface 12*b* of the rotary ring 12.

The gears 25, 29 rotate when the drive motor 20 is rotated. Since the gear 29 is in meshing engagement with the internal teeth 12*c* of the rotary ring 12, the rotary ring 12 is rotated via the ball bearing relative to the circular pipe 11 about the axial center 2*a* of the main pipe 2 (which is also the axial center of the circular pipe 11). A ball bearing 34 for supporting the rotary ring 12 is fixed to the circular pipe 11 in order to further smooth the rotation.

An insertion hole 12*e* is also formed in the external peripheral part of the rotary ring 12. Inserted into the hole 12*e* is a nozzle 13 for blowing water, sand, or another pressurized fluid material or pressurized granular material under elevated pressure. A thread is formed on the distal end of the nozzle to allow the nozzle 13 to be fixed to the rotary ring 12 by a fastener 14 such as a nut. The distal end of the nozzle 13, that is, a spray port 13*a* is disposed facing the internal surface of the lateral wall 1*b* of the manhole 1. A pressurized fluid material or pressurized granular material from a source of fluid materials or a source of granular materials (not shown) is fed to the nozzle 13 along the line shown by the dashed line 33. The fluid material or granular material sprayed from the spray port 13*a* strikes the internal surface of the lateral wall of the manhole 1 to cut the internal wall thereof. The cutting continues until the lateral wall 1*b* is cut through.

The manhole-facing opening in the circular pipe 11 is sealed with a cover 35 to prevent water, sand, debris, cuttings, or the like from entering the circular pipe 11, and the opening on the side of the main pipe 2 is also sealed as needed by a similar cover 36.

Following is a description of a method for forming a hole in a lateral wall of a manhole by using the cutting apparatus 10.

The outside diameter of the circular pipe 11 is harmonized with the inside diameter of the main pipe 2 to achieve a substantial alignment or to make the outside diameter of the circular pipe 11 slightly less than the inside diameter of the main pipe 2, so that the circular pipe 11 can be inserted into the main pipe 2 from the manhole. In the process, the main pipe is made watertight so as to prevent wastewater from entering the main pipe 2. In addition, the circular pipe 11 is brought into close contact with the internal peripheral surface of the main pipe 2 by adjusting the height of the columnar supports 23, 24.

In a case in which the axial length of the circular pipe 11 is greater than the inside diameter of the manhole and the circular pipe 11 cannot be inserted into the manhole, the circular pipe 11 may, for example, be fabricated in the form of short circular pipe units that are cut in the form of separate rings. In this case, the rings are sequentially inserted into the main pipe 2, and are assembled as the circular pipe 11.

The nozzle-equipped rotary ring 12 and the ball bearing 34 are subsequently mounted on the circular pipe 11, and the components are sealed with the cover 35 and assembled to obtain the arrangement shown in FIG. 1.

Figure 4A:
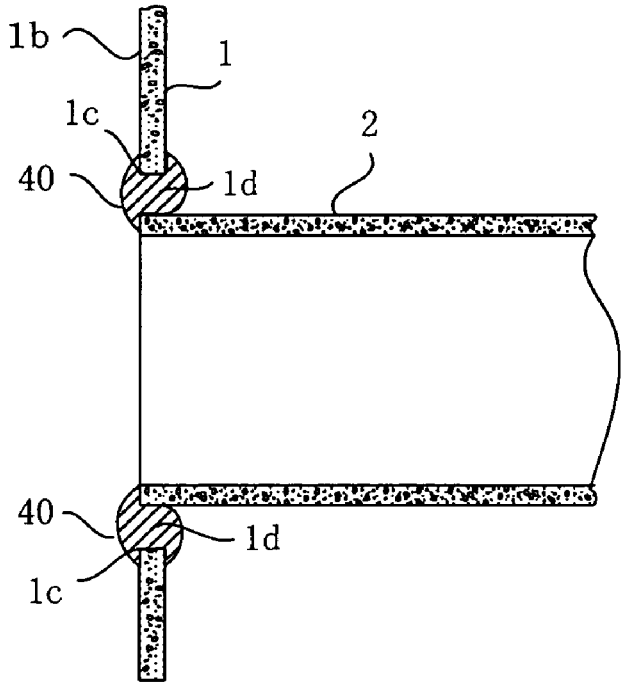
FIG. 4*a* is a cross-sectional view showing a quakeproof member that is pressed into the hole formed in a manhole.
Figure 4B:
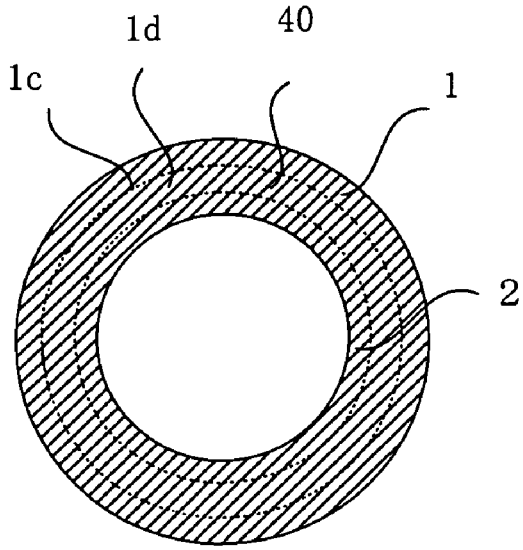
FIG. 4*b* is a side view of the left side of the quakeproof member.

Water, sand, or another pressurized fluid material or pressurized granular material is fed to the nozzle 13 via the line 33, and the drive motor 20 is driven to rotate the rotary ring 12 together with the nozzle 13 at a circumferential speed of, for example, 0.05 mm/sec to 1.0 mm/sec. The fluid material or granular material sprayed from the spray port of the nozzle 13 is blown onto the internal surface of the lateral wall 1*b* (about 10 cm thick) of the manhole 1 at a spraying pressure of about 150 to 300 MPa and a spraying diameter of 1 mm to 5 mm. This allows the lateral wall 1*b* of the manhole 1 to be cut through. The nozzle 13 rotates along periphery of the opening in the lateral wall of the manhole 1 about the axial center 2*a* of the main pipe 2 when the rotary ring 12 is rotated, and a portion of the lateral wall that is cut through forms a circle symmetrical about the axial center 2*a*. The portion of the lateral wall of the manhole that has been cut through is shown by symbol 1*c* in FIGS. 4*a* and 4*b*.

The rotational speed (circumferential speed) of the nozzle 13 is set in accordance with at least the spraying pressure of the fluid material (or granular material), and the thickness and material of the lateral wall being cut. For example, the rotational speed (circumferential speed) of the nozzle 13 may be set in accordance with the spraying pressure of the fluid material (or granular material), as well as the thickness of the lateral wall being cut so that the pipe wall can be cut through when the nozzle makes a single rotation about the axial center of the pipe. The need to rotate the nozzle several times is thereby dispensed with, making it possible to reduce the cutting time and to prevent the line 33 leading to the nozzle from becoming entangled when several rotations are made.

In a case in which a granular material is sprayed, it is possible to use garnet or a silicon-based material (silicon dioxide) or other sand material (grain size: 0.1 mm to 0.5 mm) as the granular material.

Once the portion 1*c* of the lateral wall is cut through in this manner, the lateral wall inside the circular shape is broken and removed using a hammer or other tool to form an annular hole 1*d* in the lateral wall 1*b* of the manhole, and ring-shaped quakeproof hard rubber 40 is pressed into this portion. The main pipe 2 can thus be made into a quakeproof structure.

In this embodiment, the axial center of the circular pipe 11 can be aligned with the axial center of the main pipe 2 merely by inserting the circular pipe 11 into the main pipe 2, and because the rotary ring 12 is rotated around the axial center of the circular pipe 11, the portion 1*c* that is cut through in the lateral wall of the manhole has a circular shape symmetrical about the axial center 2*a* of the main pipe 2, making it possible to form a circularly shaped through-cut part 1*c* centered on the periphery of the opening 1*a* in the manhole 1.

Figure 5:
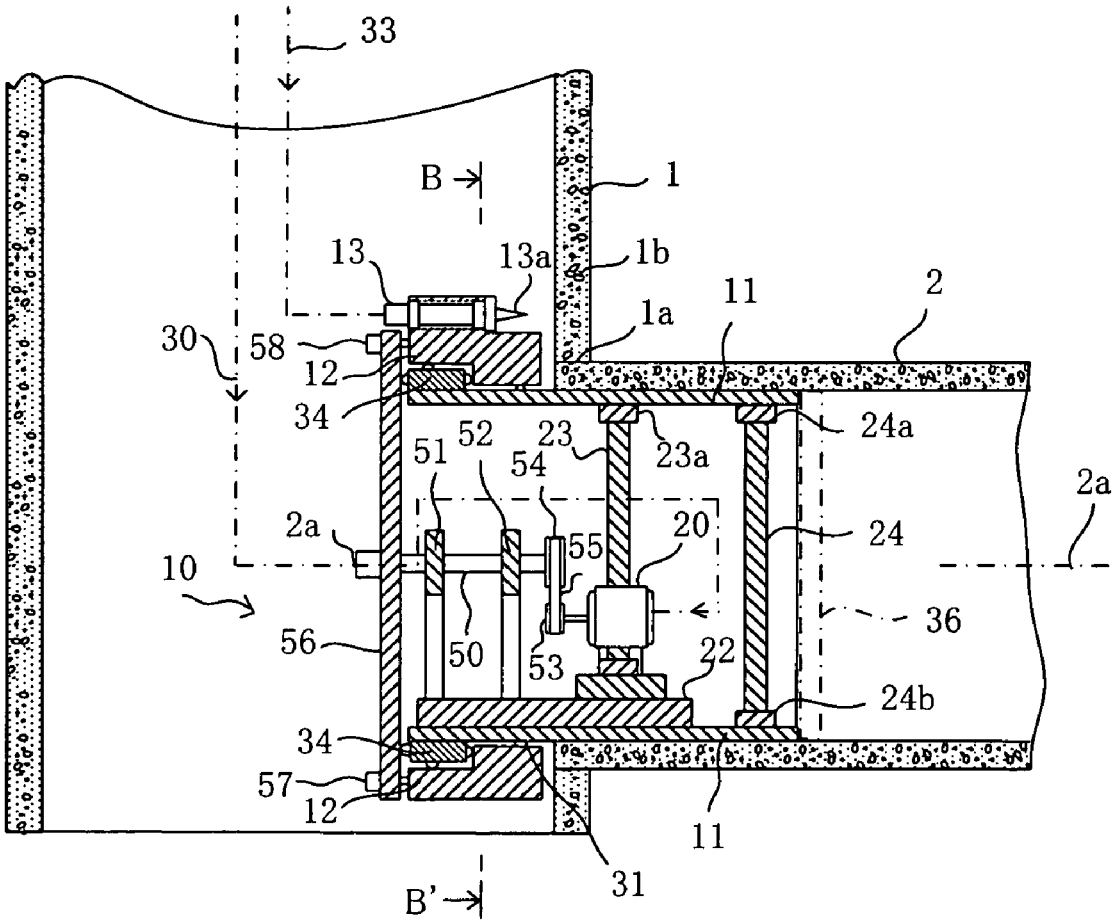
FIG. 5 is a vertical longitudinal sectional view showing another embodiment of a cutting apparatus according to the present invention.
Figure 6:
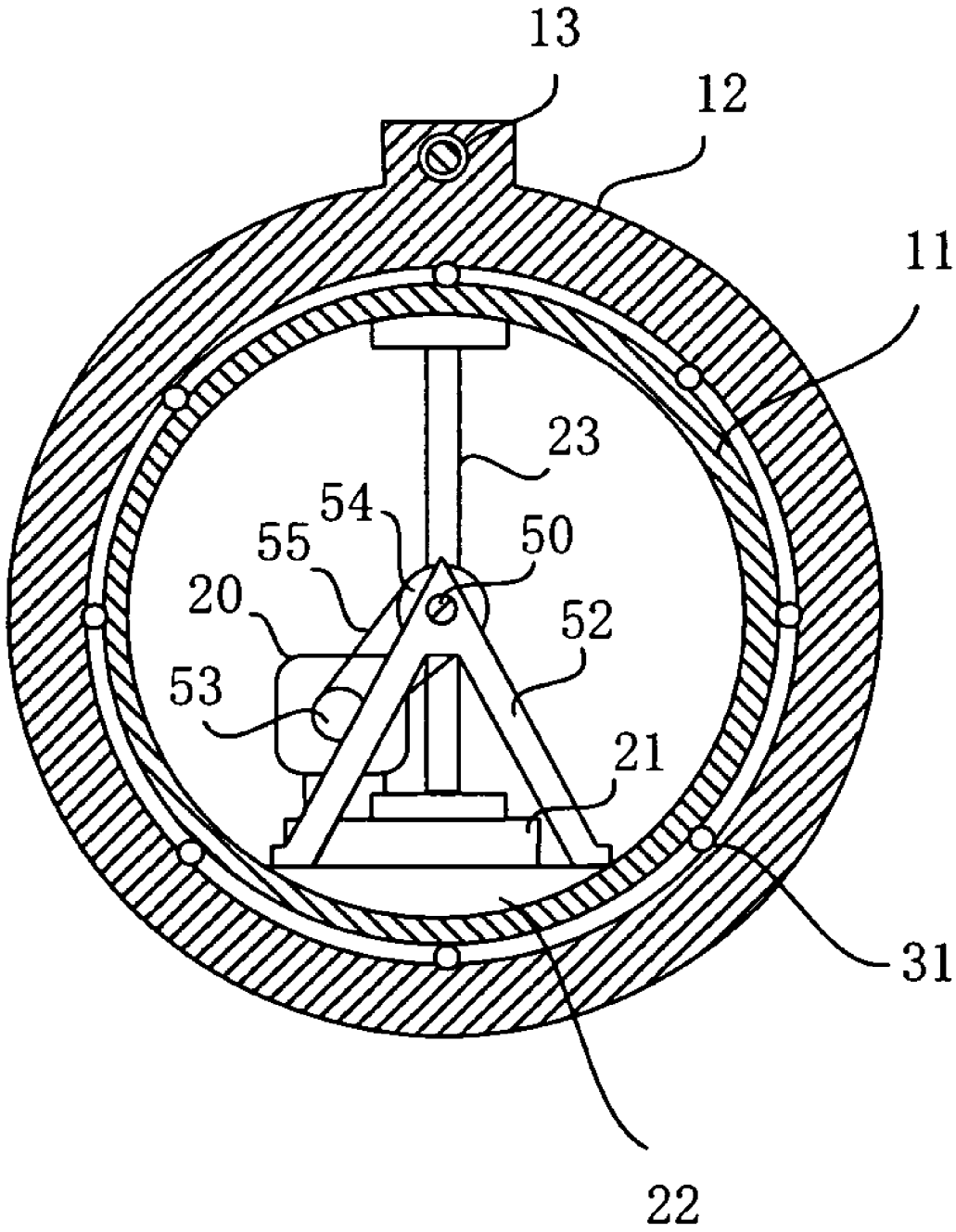
FIG. 6 is a cross-sectional view along line B-B in FIG. 5.

FIGS. 5 and 6 show another embodiment in which a shaft 50 capable of rotating about the axial center 2*a* of the main pipe 2 is mounted in the circular pipe 11 via fixed members 51, 52 and a rotary ring 12 is allowed to rotate about the shaft 50. The same reference symbols are attached to the same portions as in the example described with reference to FIG. 1 and other drawings, and a detailed description of these portions is omitted.

The fixed members 51, 52 mounted on the base 22 of the circular pipe 11 are shaped as angular members in the form of triangles, as shown in FIG. 6, and the shaft 50 is rotatably supported by bearings in the top parts of the angular members. The shaft 50 is centered so that the axial center thereof is substantially aligned with the axial center 2*a* of the main pipe 2.

A disk 56, which is fixed in the rotary ring 12 via fixing tools 57, 58, is fixed to the manhole-facing end part of the shaft 50. A pulley 54 for receiving torque from a drive motor 20 via a pulley 53 and belt 55 is mounted on the other end of the shaft 50.

In such a structure, starting the drive motor 20 will cause the disk 56 to rotate about the shaft 50, and the rotary ring 12 fixed to the disk 56 to rotate about the axial center 2*a* of the main pipe 2. The lateral wall 1*b* of the manhole will be cut by the nozzle 13 held in the rotary ring 12, and a circularly shaped through-cut part 1*c* will be formed along the periphery of the opening 1*a* of the manhole 1 in the same manner as in the above-mentioned embodiment.

In the embodiment in FIGS. 5 and 6 as well, a centered, circularly shaped through-cut portion can be formed in the same manner as in the embodiment in FIG. 1 because the nozzle 13 held in the rotary ring 12 can rotate together with the rotary ring 12 about the axial center 2*a* of the main pipe 2.

Figure 7:
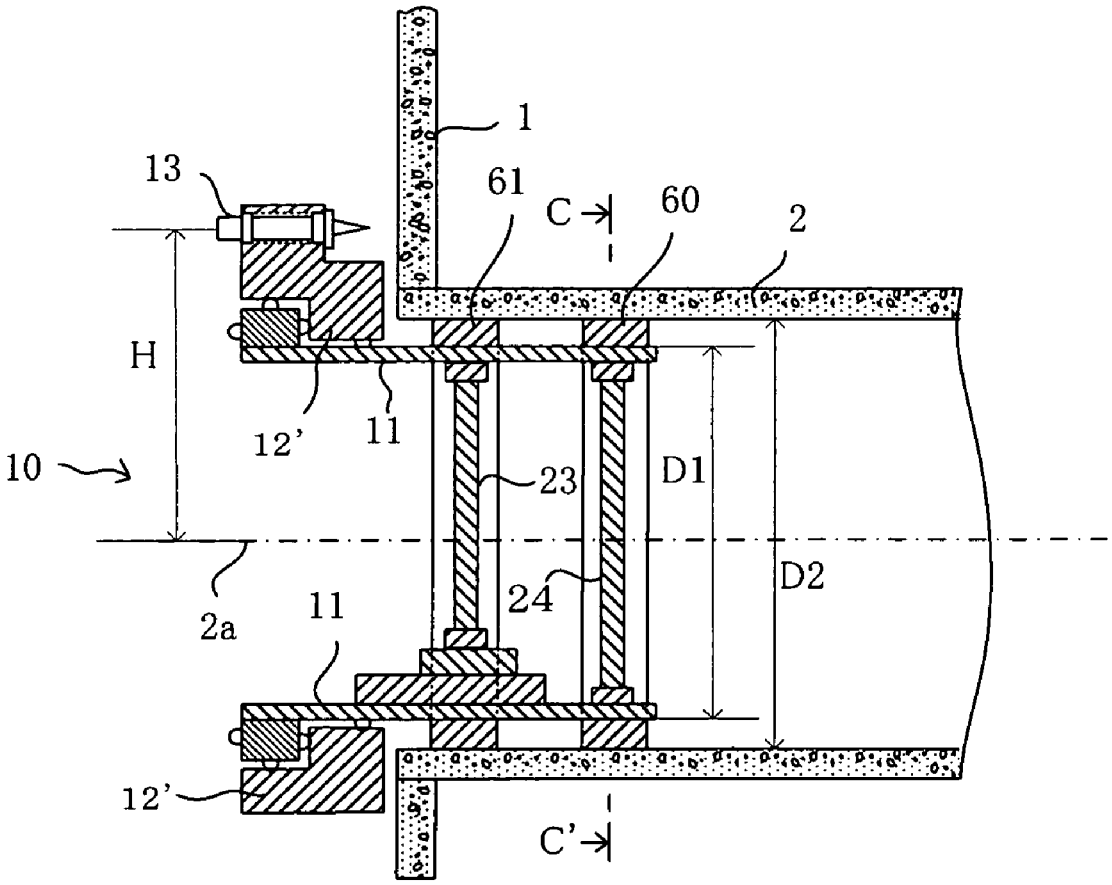
FIG. 7 is a vertical longitudinal sectional view showing still another embodiment of a cutting apparatus in which the main pipe has a large inside diameter.
Figure 8:
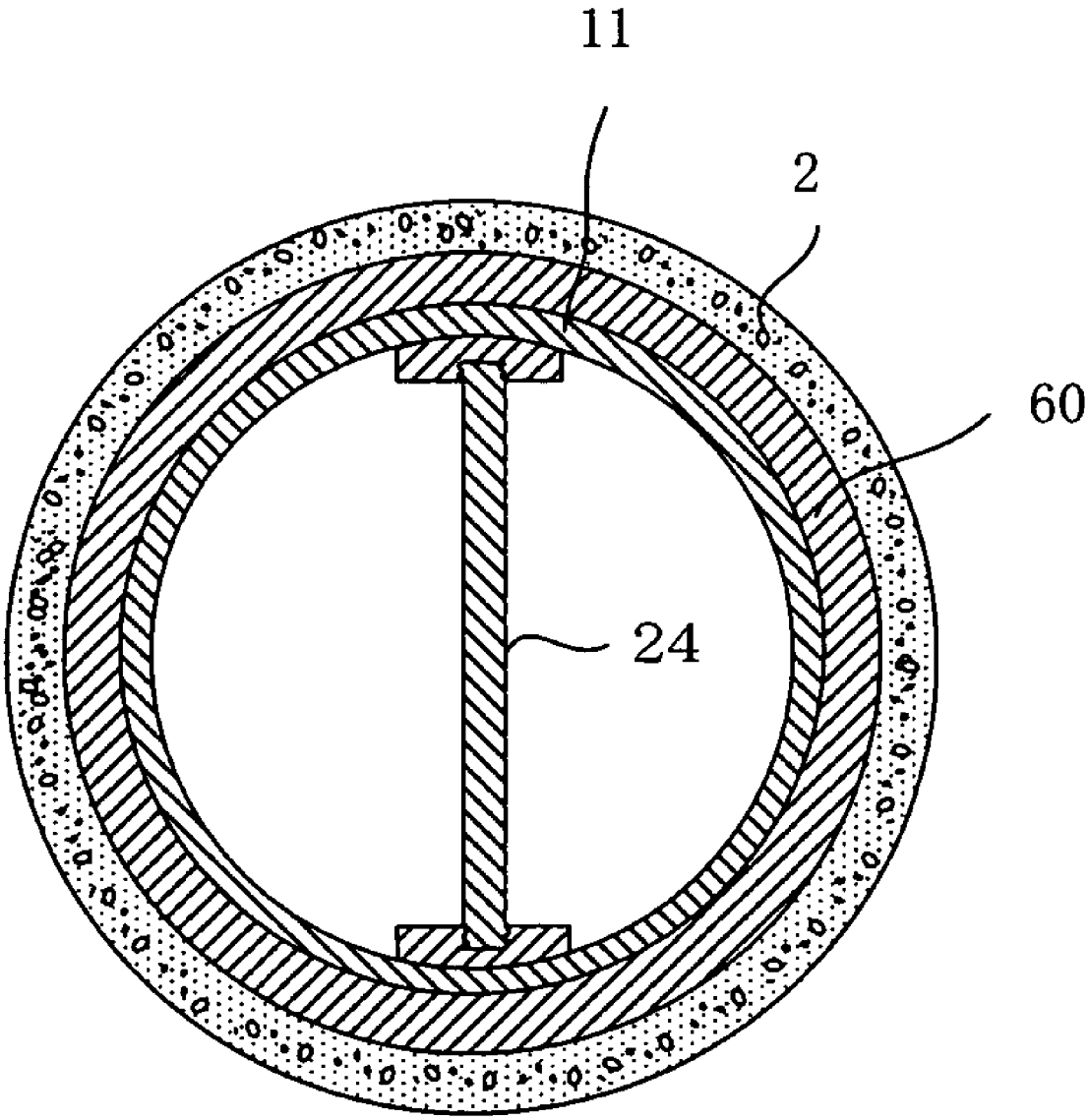
FIG. 8 is a cross-sectional view along line C-C in FIG. 7.

In a case in which the main pipe 2 has a large inside diameter in above-mentioned embodiments, a circular pipe is used whose outside diameter corresponds to the inside diameter of the main pipe 2. Alternatively, the circular pipe can be harmonized with the inside diameter of the main pipe by using a spacer and fashioning the circular pipe to a small inside diameter. For example, the diameter of the circular pipe 11 can be harmonized with the diameter of the main pipe 2 by using spacer rings 60, 61 having an outside diameter of D2 and an inside diameter of D1, where D1 is the outside diameter of the circular pipe 11, and D2 is the inside diameter of the main pipe 2, as shown in FIGS. 7 and 8. In such a case, the spacer rings 60, 61 are first placed inside the main pipe 2, and the circular pipe 11 is then inserted into the spacer rings 60, 61, whereby the rotational center of the nozzle 13 can be aligned with the axial center 2*a* of the main pipe 2 in a simple manner. A single spacer ring may be used as needed, or more than two spacer rings may also be used. In such an arrangement, a single circular pipe is prepared whose outside diameter is harmonized with the inside diameter of a main pipe having a minimal diameter. In a case in which the main pipe has a greater inside diameter than that of the main pipe of the minimal diameter, spacers such as those described above are used to harmonize and align the diameter of the circular pipe with the greater diameter of the main pipe. This makes it unnecessary to prepare circular pipes having a plurality of diameters.

In a case of a main pipe having a large inside diameter, the cutting height can be adjusted using a rotary ring in which the height H of the nozzle 13 from the axial center 2*a* is increased in accordance with the diameter of the main pipe.

What is claimed is:

1. An apparatus for cutting a lateral wall of a first pipe to form a hole in the lateral wall thereof, the first pipe having an opening at which the first pipe intersects and communicates with a second pipe, the apparatus comprising:

a fixed member which is fixedly disposed in the second pipe, the fixed member being harmonized with the diameter of the second pipe;

a rotating member linked to the fixed member so as to be able to rotate inside the first pipe along a periphery of the opening thereof about an axial center of the second pipe; and a nozzle having a spray port that is mounted to the rotating member such that the spray port faces an internal surface of the lateral wall of the first pipe;

wherein the rotating member is rotated relative to the fixed member, and a pressurized fluid material or a pressurized granular material is sprayed from the spray port of the nozzle to cut the lateral wall along the periphery of the opening in the first pipe, and wherein a shaft whose axial center is aligned with the axial center of the second pipe is mounted inside the fixed member, and the rotating member is allowed to rotate about the shaft.

2. An apparatus for cutting a lateral wall of a first pipe to form a hole in the lateral wall thereof, the first pipe having an opening at which the first pipe intersects and communicates with a second pipe, the apparatus comprising:

a fixed member which is fixedly disposed in the second pipe, the fixed member being harmonized with the diameter of the second pipe;

a rotating member linked to the fixed member so as to be able to rotate inside the first pipe along a periphery of the opening thereof about an axial center of the second pipe; and a nozzle having a spray port that is mounted to the rotating member such that the spray port faces an internal surface of the lateral wall of the first pipe;

wherein the rotating member is rotated relative to the fixed member, and a pressurized fluid material or a pressurized granular material is sprayed from the spray port of the nozzle to cut the lateral wall along the periphery of the opening in the first pipe, and wherein a spacer ring is inserted between the fixed member and the second pipe when an outside diameter of the fixed member is less than an inside diameter of the second pipe.

3. An apparatus for cutting a lateral wall of a first pipe to form a hole in the lateral wall thereof, the first pipe having an opening at which the first pipe intersects and communicates with a second pipe, the apparatus comprising:

a fixed member which is fixedly disposed in the second pipe, the fixed member being harmonized with the diameter of the second pipe;

a rotating member linked to the fixed member so as to be able to rotate inside the first pipe along a periphery of the opening thereof about an axial center of the second pipe; and a nozzle having a spray port that is mounted to the rotating member such that the spray port faces an internal surface of the lateral wall of the first pipe;

wherein the rotating member is rotated relative to the fixed member, and a pressurized fluid material or a pressurized granular material is sprayed from the spray port of the nozzle to cut the lateral wall along the periphery of the opening in the first pipe, and wherein the rotational speed of the nozzle is determined at least in accordance with the spraying pressure of the fluid material or granular material and the thickness of the lateral wall being cut.

4. An apparatus according to claim 3 wherein the fluid material is water and the granular material is sand.

5. An apparatus according to claim 3, wherein a spacer ring is inserted between the fixed member and the second pipe when an outside diameter of the fixed member is less than an inside diameter of the second pipe.

6. An apparatus according to claim 3, wherein a shaft whose axial center is aligned with the axial center of the second pipe is mounted inside the fixed member, and the rotating member is allowed to rotate about the shaft.

7. An apparatus according to claim 3, wherein the fixed member is shaped as a circular pipe, and the rotating member is mounted on the fixed member so as to be able to rotate about an axial center of the fixed member.

8. An apparatus according to claim 2, wherein a shaft whose axial center is aligned with the axial center of the second pipe is mounted inside the fixed member, and the rotating member is allowed to rotate about the shaft.

9. An apparatus according to claim 2, wherein the fixed member is shaped as a circular pipe, and the rotating member is mounted on the fixed member so as to be able to rotate about an axial center of the fixed member.

* * * * *